US005348200A

United States Patent [19]

Van Den Berghe

[11] Patent Number: 5,348,200

[45] Date of Patent: Sep. 20, 1994

[54] AUTOMATIC CLOSURE FOR A CONTAINER

[76] Inventor: Al Van Den Berghe, 5313 Monterey Rd., Los Angeles, Calif. 90042

[21] Appl. No.: 68,765

[22] Filed: May 28, 1993

Related U.S. Application Data

[63] Continuation of Ser. No. 715,574, Jun. 14, 1991, Pat. No. 5,240,154.

[51] Int. Cl.[5] ..... B67D 3/00

[52] U.S. Cl. ..... 222/514; 222/518; 222/525; 222/531; 222/537; 222/559; 222/563; 222/83; 222/541

[58] Field of Search ..... 222/461, 462, 511, 513, 222/514, 518, 522, 523, 525, 531, 537, 559, 546, 563, 83, 83.5, 541

[56] References Cited

U.S. PATENT DOCUMENTS

| | | | |
|---|---|---|---|
| 2,638,613 | 5/1953 | Gunther | 222/563 X |
| 3,343,719 | 9/1967 | Kastamo et al. | 222/514 X |
| 3,405,849 | 10/1968 | Kellogg | 222/498 |
| 5,230,447 | 7/1993 | Kirk | 222/514 X |

*Primary Examiner*—Andres Kashnikow
*Assistant Examiner*—Anthoula Pomrening
*Attorney, Agent, or Firm*—Beehler & Pavitt

[57] ABSTRACT

A closure system for a container which is capable of being manufactured as a single integrated unit. The closure system includes a bellows member which carries a closure member between a closed position and an open position.

14 Claims, 5 Drawing Sheets

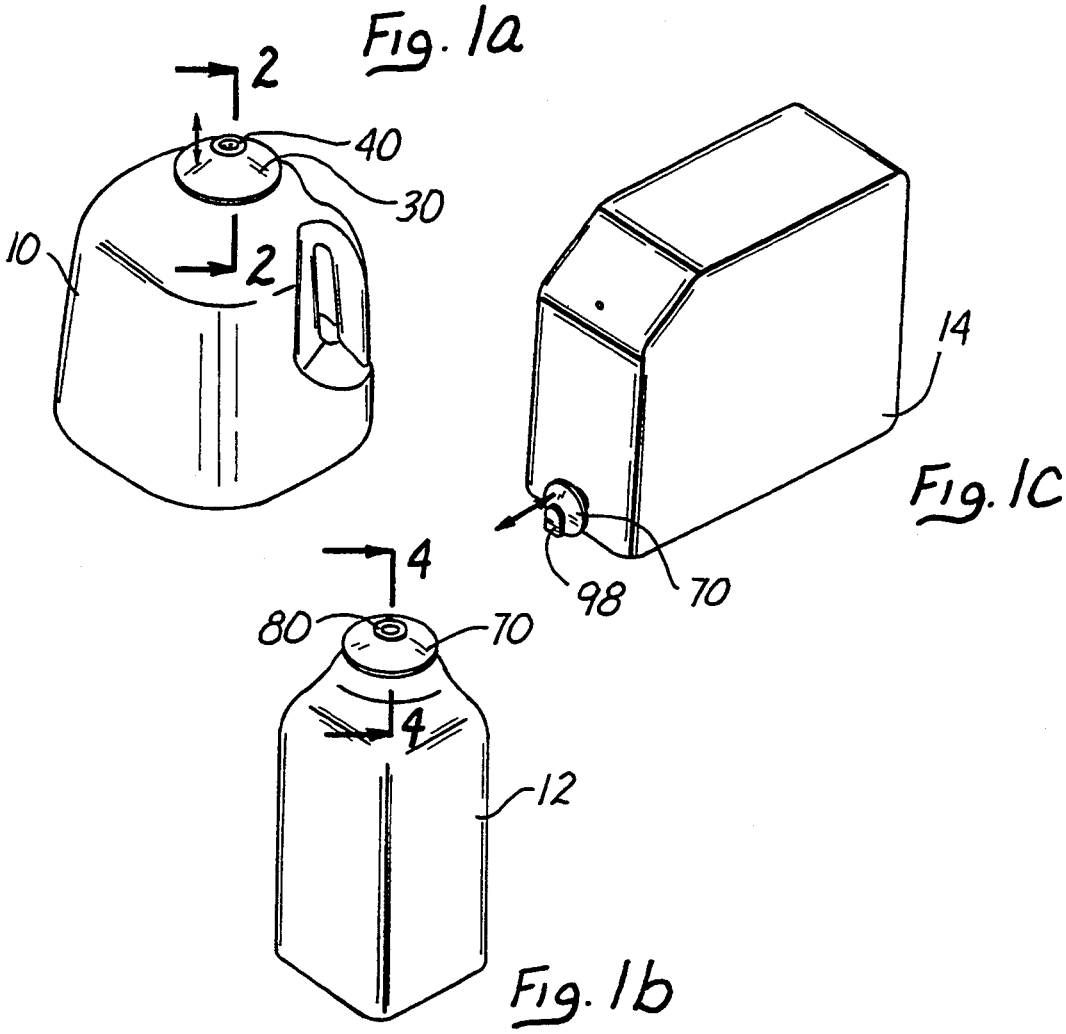
Fig. 1a
2
40
30
10
2
14
Fig. 1C
98
70
4
80
70
4
12
Fig. 1b
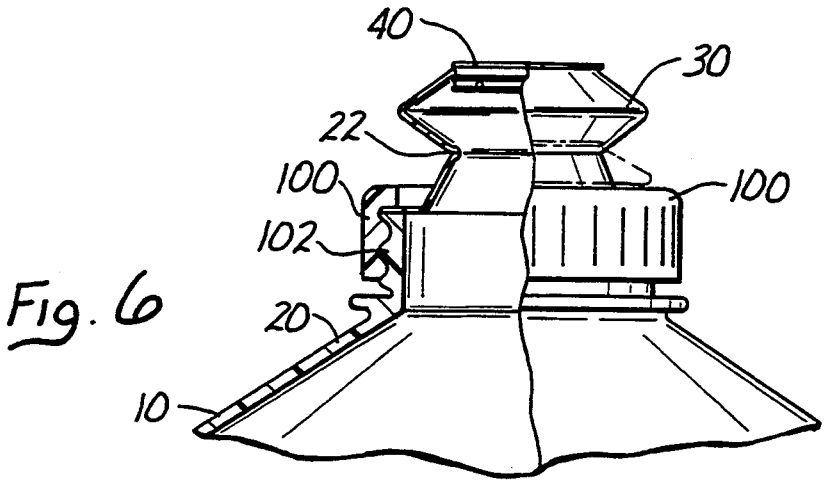
40
30
22
100
100
102
20
10
Fig. 6

Fig. 5
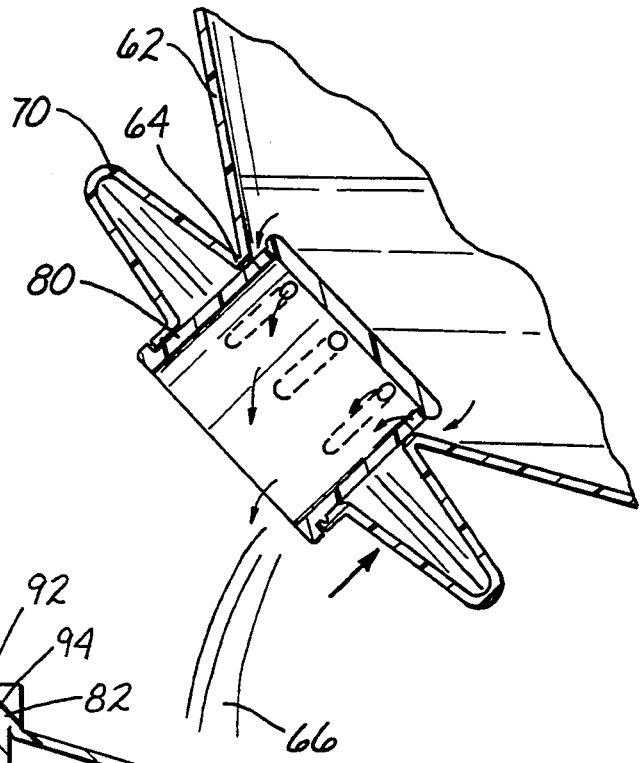
Fig. 4a
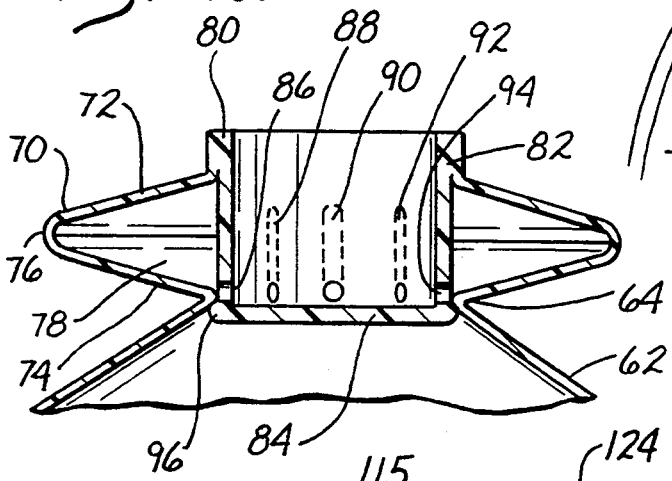
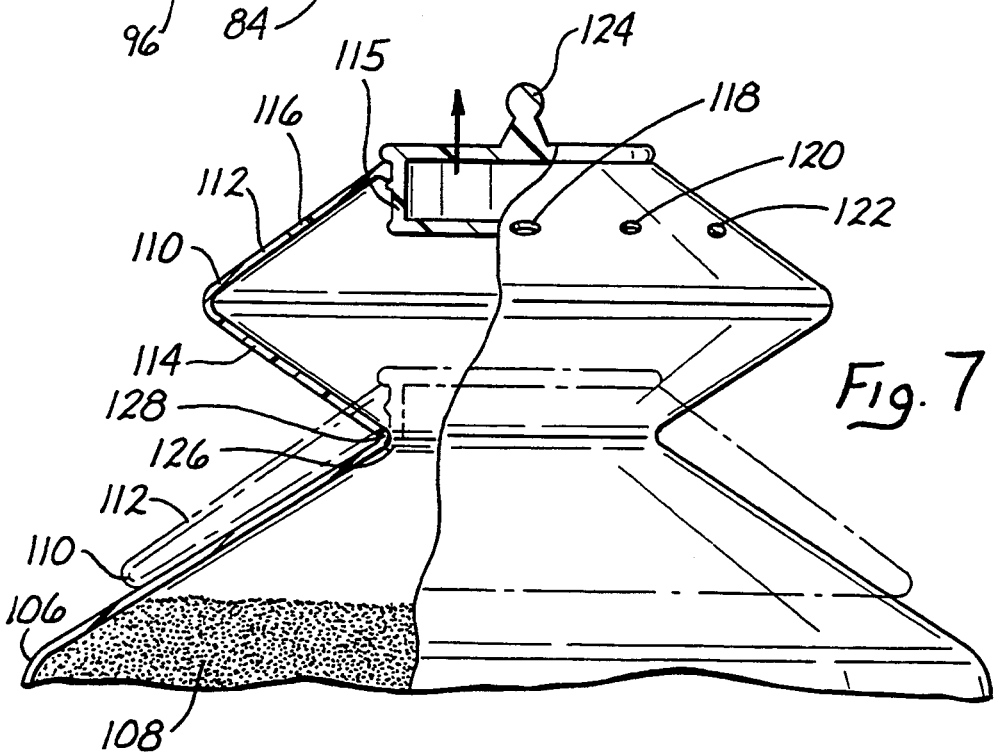
Fig. 7

AUTOMATIC CLOSURE FOR A CONTAINER

This is a continuation application under 37 CFR 1.60 of prior application Ser. No. 07/715,574 filed Jun. 14, 1991 which resulted in the issuance of U.S. Pat. No. 5,240,154 on Aug. 31, 1993 to Al Van Den Berghe.

FIELD OF THE INVENTION

The present invention generally relates to closure systems for containers and, more specifically, to closure systems which include non-removable closure members.

BACKGROUND OF THE INVENTION

A wide variety of containers include closure systems which allow for the alternate opening and closing of the container without removal of a cap portion from the container. Examples of such systems are shown in U.S. Pat. No. 4,442,958 issued to Amos; U.S. Pat. No. 1,958,414 issued to Bogeaus; U.S. Pat. No. 3,321,114 issued to Croyle; U.S. Pat. No. 3,193,154 issued to Bross; U.S. Pat. No. 529,221 issued to Wagner; U.S. Pat. No. 2,207,816 issued to Packer; U.S. Pat. No. 2,768,771 issued to Beutel; U.S. Pat. Nos. 1,958,430 and 1,958,434 issued to Hartog; U.S. Pat. No. 2,699,885 issued to McClure; U.S. Pat. No. 85,521 issued to Gardner; U.S. Pat. No. 3,690,520 issued to Sarris; U.S. Pat. No. 564,242 issued to Burlich; U.S. Pat. No. 218,698 issued to Beardsley; and U.S. Pat. No. 1,247,497 issued to Brown.

These previous expedients each provide a means by which a first portion of a closure device is movable with respect to a second portion of the closure device. This relative movement allows the closure device to be placed into either an open position in which the contents of a container can flow out of the container or a closed position in which the contents of the container are restricted from flowing out of the container. The elements which are movable with respect to one another have heretofore been manufactured separately and assembled together to provide a single closure device with at least two component parts moving relative to each other.

The use of several component parts in the manufacture of any product is often avoided for several reasons. One important consideration is, of course, the cost of production. Manufacturing costs are increased in proportion to the number of component parts needed for each closure device. In addition, the time for assembling each of the component parts increases the cost of the device.

Another important consideration in the manufacture of closure devices is quality, particularly the ability of the system to prevent leaking when the device is in its closed position. When more than one component part is used, the integrity of each component part, as well as their precise and accurate assembly, presents several unwanted opportunities for failure in the overall quality of the final assembled device.

For these and other reasons, there has been a long felt need to provide closure devices having as few component parts as possible.

The use of bellows to provide a device of unitary construction with individual portions which are movable with respect to one another is well known in devices such as accordions and collapsible bottles of the type disclosed in U.S. Pat. No. 32,379, and the freshness and tamper monitoring closure of U.S. Pat. No. 4,887,730.

However, previous expedients have failed to recognize the possibility of using flexible or bellow-type construction on closure devices for eliminating the many problems inherent in manufacturing closure devices with several component parts.

SUMMARY OF THE INVENTION

This invention is a closure system for a container which is capable of being manufactured as a single integrated unit. The invention includes a port element, a closure member, a bellows member, and outlet means.

The port element is adapted to permit the flow of a fluid material into and out of a cavity inside of the container. In its simpler form, the port element preferably is simply a hole in the container. The port element also preferably includes any extension of the container which provides a continuous passage from the hole. This passage provides an opening, or throat, through which the contents of-the container can flow from the cavity inside of the container. The passage can, of course, be any geometrical shape, but is preferably generally cylindrical.

It is anticipated that the contents to be poured from the container might include any one of a group of fluid materials including liquids, gasses, or small granular particles such as powders, which are capable of flowing through the port element provided. Most of the embodiments described hereinafter are adapted for liquid contents to be poured from the container, and one of the embodiments described hereinafter is designed preferably to be used with solid material such as powders and the like. This system can easily be adapted to provide a closure system for any fluid material.

The closure member is adapted to be moved with respect to the port element. In one embodiment, the closure member is moved from an initial closed position to a permanent open position. In another embodiment, the closure member can be alternately moved back and forth between a closed position and an open position. In either embodiment, the closed position prevents the flow of fluid material through the port element and the open position allows the flow of fluid materials through the port element. Preferably, the closure member performs the function of a plug to close the passage or throat of the port element. The shape and size of the closure member comports to the size and shape of the opening of the port element, whereby the placement of the closure member into the port element plugs the passage to prevent the flow of fluid material therethrough.

The bellows member can be any one of various enclosures of variable volume with walls that can be alternately expanded and contracted to move the closure member between its open and closed positions. In one embodiment, the bellows member is fixed at a first end to the port element and the bellows member is made to contact the closure member at a second end. The contact between the closure member and the bellows member provides the means by which the closure member is moved from its closed position into its open position. No means are provided to move the closure member back to its closed position in this embodiment. This embodiment is preferred when the contents of the container is material that is to be used completely after initial opening of the container, for instance, automotive products and the like.

Another preferred embodiment provides means by which the closure member is movable back and forth between its open and closed position in the port element. In this embodiment, the bellows member is not only fixed to the port element, but also fixed at the second end to the closure member.

The use of bellows in a closure system provides several advantages over prior expedients. The bellows provide the means by which the closure member is maintained continuously connected to the container. Further, the bellows can be made of a sufficiently stiff material to axially align the closure member with the port element. This alignment does not require the precise assembly of a variety of separate parts, as in prior expedients.

The bellows member can be integrally formed to one, or both, of the closure member and/or the port element. To the extent that the bellows is integrally formed with any other portion of the closure system, the potential for leakage at that point of the system is thereby reduced.

The walls of the bellows member necessarily contain a space therein. This space within the bellows member communicates with the port element when the closure member is in its open position, thereby allowing fluid material to flow through the port element from the cavity into this space.

Outlet means are provided either in the bellows member or in the closure member for allowing any fluid material flowing into the space in the bellows member to continue to flow out of the system into the outside environment when the closure member is in its open position. In one embodiment, the outlet means include one or more holes in the bellows member which are preferably aligned with the port element to provide a continuous and substantially straight passage for fluid material of a solid granular nature. In an alternate embodiment, the outlet means include one or more holes in the closure member which are not necessarily substantially aligned with the port element.

In one embodiment, the outlet means are sealed to preferably prevent leakage and tampering. In this embodiment, a strip of foil is preferably fixed to the bellows member and the bellows member is adapted to move with respect to the closure member in such a way as to allow a puncturing surface of the closure member to puncture the foil and thereby allow the outlet means to be unsealed by the same movement which initially opens the system.

The walls of the bellows member are necessarily flexible to allow for the bellows member to expand and contract. The walls are also preferably resilient. In one embodiment, the bellows member supports the closure member in its open position when the bellows member is in its relaxed state and the bellows member supports the closure member in its closed position when the walls of the bellows member are in their non-relaxed state. In this embodiment, temporary locking means are preferably provided for locking the closure member in its closed position. These temporary locking means preferably include the closure member having a mating flange element which is adapted to temporarily mate with the port element when the bellows member is in its non-relaxed state.

An alternative embodiment includes the bellows member supporting the closure member in its closed position when the bellows member is in its relaxed state. In this embodiment, the closure member is preferably provided with temporarily locking means which are operable when the closure member is in its open position.

The bellows member preferably includes a first conical surface and a second conical surface integrally formed with and opposed to the first conical surface. The integral formation of the conical surfaces and the preferable integral formation of the bellows member with the port element is preferably flexible and resilient.

The system may also be provided with directed spout means for directing the fluid material flowing from the outlet means. Such directed spout means can easily be fixed to any portion of the system. The directed spout means provide the user of the system with a means to direct the flow of the fluid material in any direction desired.

The closure system may further include handle means for allowing the user of a system to easily move the closure member between its open and closed positions. The handle means are preferably fixed to the closure member.

The closure system can be used with a wide variety of containers. The design of the closure system, and the materials used to make the system, can be slightly altered to provide the desired qualities and performance depending on the size, shape, and contents of the container.

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

BRIEF DESCRIPTION OF THE DRAWINGS

FIGS. 1(*a*), 1(*b*), and 1(*c*) are perspective views of three alternative container designs which are adapted to include preferred embodiments of this invention.

FIG. 4(*a*) is the cross-sectional view taken along line 4—4 shown in FIG. 1(*b*), illustrating yet another embodiment of the invention.

FIG. 5 is the same cross-sectional view of FIG. 4 illustrating the closure device in its open position.

FIG. 6 is a side elevational view of yet another embodiment partially showing a cross-sectional view, and partially illustrating an alternate closed operative position in broken lines.

FIG. 7 is a partially cross-sectional side elevational view of yet another embodiment of the invention illustrating the device in solid lines in its open position, and in broken lines in its closed position.

DETAILED DESCRIPTION OF THE PREFERRED EMBODIMENTS

Figure 2:
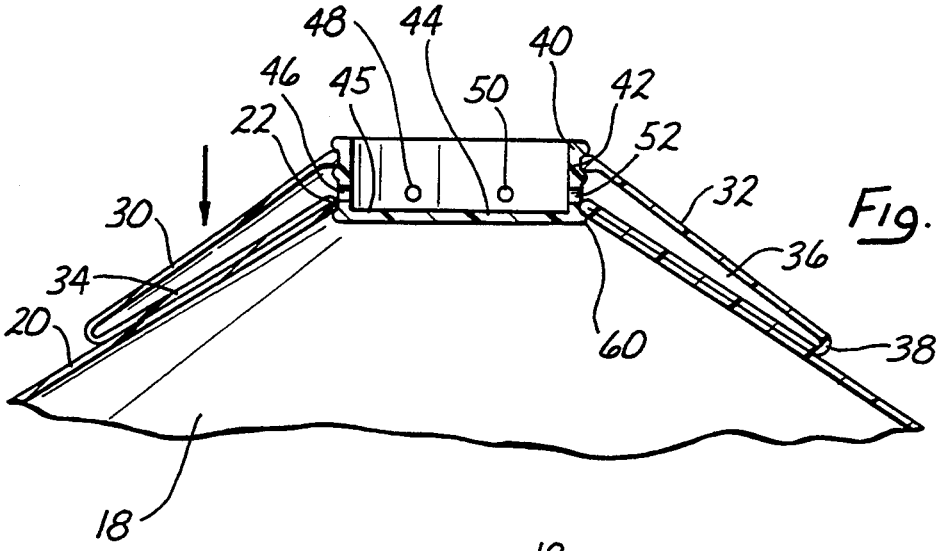
FIG. 2 is a cross-sectional view taken along line 2—2 in FIG. 1(*a*), illustrating a first preferred embodiment of the closure system in its closed position.

Several embodiments of this invention are shown in the drawings. In several instances, these embodiments may be used in different combinations to achieve different performance characteristics. The common features in all of the embodiments include a closure member, a port element, a bellows member, and outlet.

A first preferred embodiment is shown in FIGS. 1(*a*), 2 and 3. The closure system is integrally formed, in this embodiment, at the top portion 20 of container 10. Container 10 can be any size or shape which might be used to hold liquid contents. Container 10 shown in FIG. 1(*a*), for example, is a typical one-gallon milk or juice carton seen regularly on supermarket shelves. This embodiment is shown in FIG. 2 in its closed position, and in FIG. 3 in its open position.

The port element includes a neck portion 22 and throat area 24. The port element is merely a hole at the top 20 of container 10 which provides a passage for the fluid contents 16 of container 10 to flow from the cavity 18 therein. The contents of the container 10 are, in this case, a liquid 16.

The closure member in this embodiment is cup-shaped member 40. Cup-shaped member 40 has generally cylindrical side walls 42 and a generally circular base 44. A lower portion of side walls 42 and circular base 44 define plug means 45 which are adapted to closely fit within throat 24 to provide a liquid-type seal through which liquid 16 cannot flow though throat 24. When plug 45 is positioned within throat 24, liquid 16 is prevented from flowing through throat 24. This closed position is shown in FIG. 2.

Figure 3:
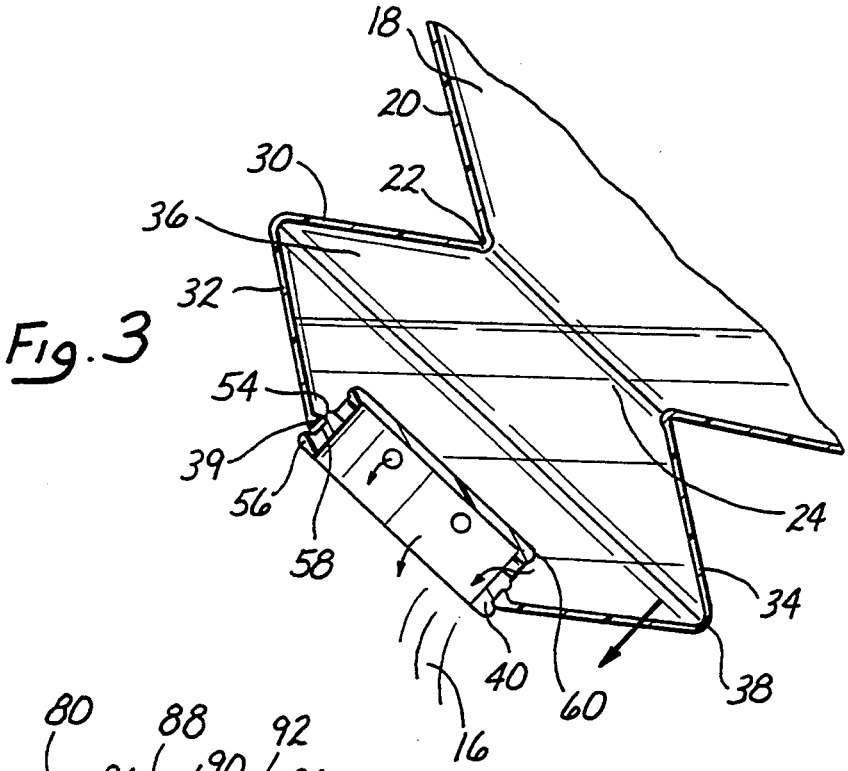
FIG. 3 is the same cross-sectional view of the closure device in FIG. 2 shown in its open position.

When the plug 45 is not being received within throat 24, the liquid 16 is allowed to flow freely through throat area 24, resulting in the open position shown in FIG. 3.

Outlet means are provided in this embodiment by way of a plurality of spoutholes, four of which are shown as holes 46, 48 50 and 52. As shown in FIG. 3, when the liquid 16 is allowed to flow through the throat area 24, the liquid continues to flow through the spoutholes 46, 48, 50, and 52 and into the outside environment.

The bellows member 30 is shown in FIG. 2 in its compressed state holding closure member 40 in its closed position. The bellows member 30 is shown in FIG. 3 in its relaxed state holding closure member 40 in its open position.

Bellows member 30 is comprised of a first conical surface 32 which is integrally formed with an opposed second conical surface 34 at outside rim 38. The second conical surface 34 is similarly integrally formed with the neck portion 22 at the top 20 of container 10. The material used to manufacture bellows member 30, is preferably of a flexible nature which allows the compression of the first surface 32 towards second surface 34 forming the closed position shown in FIG. 2. The material is also preferably resilient which biases the bellows member 30 into the open position shown in FIG. 3. The natural resiliency in the materials used to manufacture bellows member 30 is adapted to maintain closure member 40 in its open position.

The lower portion of side walls 42 is further provided with a circumferential flange 60 which is adapted to provide a snapping mechanism by which the closure member 40 can be temporarily locked into its closed position by engagement of the flange 60 with the inside circumferential edge of neck portion 22.

The closure member 40 is fixed to the bellows member 30 along the upper portion of cylindrical side wall 42. Circumferential projections 54 and 56 define a circumferential channel 58 within which circumferential edge 39 is snap mated or press fit with closure member 40. Closure member 40 is preferably snap mated in this way after container 10 is filled with liquid 16.

Closure member 40 is axially aligned with neck portion 22 to provide easy and accurate movement of closure member 40 into its open and closed positions. Space 36 within walls 32 and 34 of bellows member 30 defines an intermediate passageway through which liquid 16 is allowed to flow from throat area 24 through outlet holes 46, 48, 50, and 52. This embodiment is provided with a means for locking the cup-shaped closure member 40 into its closed position for insulating the liquid 16 during storage and protecting against spills or leakage if container 10 is moved about. These temporary locking means are provided by an outwardly extending radial flange 60. Flange 60 is adapted to temporarily mate with the inside surface of neck portion 22 when the bellows member 30 is compressed.

In operation, closure member 40 is pushed into container 10 to plug the throat area 24. This creates the closed position shown in FIG. 2 in which liquid 16 is prevented from flowing through outlet holes 46, 48, 50, and 52. The user can move closure member 40 away from the container 10 to provide the open position shown in FIG. 3 in which liquid 16 is allowed to flow freely through throat area 24 and space 36 and on through outlet holes 46, 48, 50, and 52.

The manner in which the user would most easily manipulate the closure member 40 between its opened and closed positions would be by grasping the rim portion 38 of bellows member 30 at which the conical surfaces 32 and 34 are integrally formed.

Figure 4:
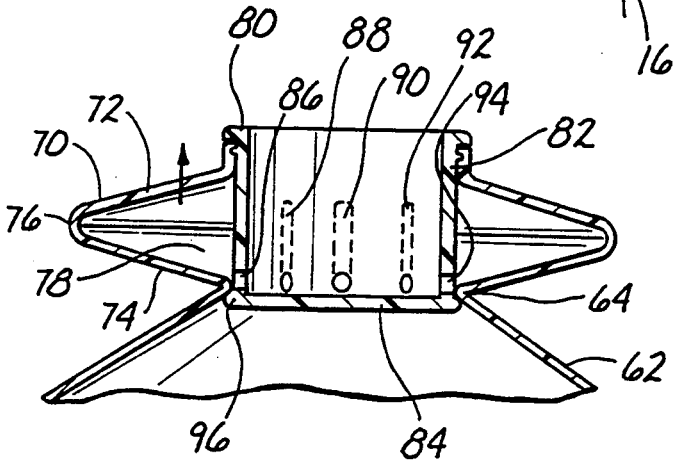
FIG. 4 is a cross-sectional view taken along line 4—4 shown in FIG. 1(*b*), illustrating a second preferred embodiment of the invention in its closed position.

A second preferred embodiment is shown, in detail, in FIGS. 4 and 5. This embodiment provides a safety feature which automatically places the closure member into its closed position whenever it is not being positively manipulated into its open position. This safety feature is appropriate in any situation in which it is important to maintain a closed environment for the contents of the container whenever the contents are not being poured from the container (for example, liquids with dangerous fumes, unpleasant fumes, carbonated or flammable liquids, etc.). If the contents of the container are flammable, for instance lighter fluid, and the fluid is accidentally ignited as it is being poured from the container, the immediate instinctive reaction of the user will be to let go of the container resulting in the almost instantaneous and automatic closure of the container preventing the explosion of the container and its contents. This safety feature is also available for use on containers which are constantly and easily knocked over and, if left open, would spill the contents (i.e., baby bottles). This safety feature further eliminates the need for a funnel in directing a narrow flow of liquid. The container can be turned upside down and placed directly over a small opening (such as a radiator, gas tank, etc.) without leaking. When the container is over the opening, the bellows member can be compressed into its open position directing the contents directly into the opening. The bellows member can be compressed by forcing the bellows member against the rim of the opening. Additionally, the container can be marked with appropriate graduations, assisting the user in pouring only a measured portion of the contents from the container.

Figure 8:
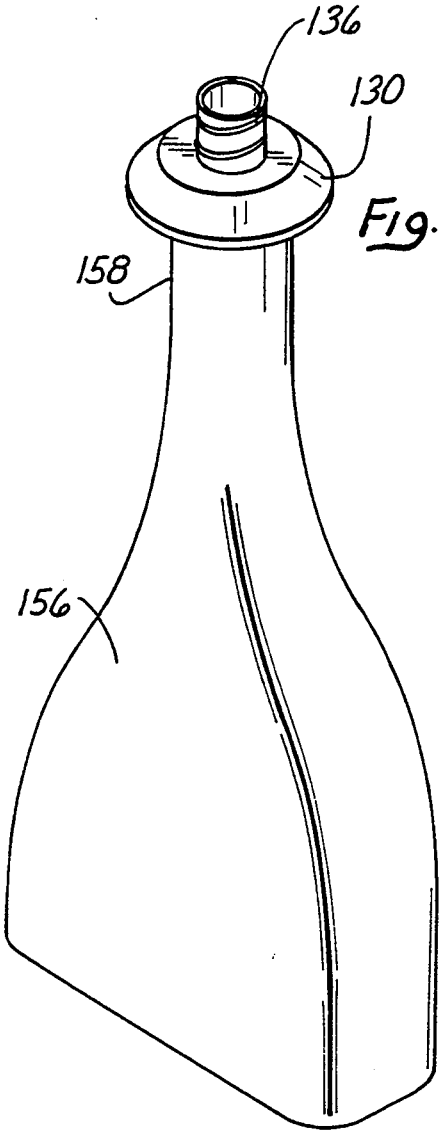
FIG. 8 is a perspective view of yet another embodiment of the invention on a fourth type of container.

For ease of explanation, this second embodiment will be referred to herein as the bouncer embodiment, because it automatically bounces to the closed position. Like most embodiments described herein, the bouncer can be used on containers of any size, shape, or design. The bouncer is preferably used on containers such as those shown in FIGS. 1*b*, 1*c*, or 8. The top portion 62 of the container is integrally formed with the port element or neck portion 64 of the bouncer. Bellows member 70 comprises upper conical surface 72 and opposed conical surface 74 which are integrally formed at midportion 76. Bellows member 70 encloses space 78.

The upper conical surface 72 is fixed with respect to the closure member 80 in the same manner that the upper conical surface 32 on FIGS. 2 and 3 are fixed with respect to closure member 40 in the first embodiment.

Closure member or cup-shaped member 80 includes cylindrical side wall 82 and circular base 84. Outlet means are provided on side wall 82. These outlet means are preferably located in equally spaced apart positions around the circumference of side wall 82, five of which are shown as holes 86, 88, 90, 92, and 94.

The base 84 is provided with flange 96 which contacts the inside circumference of neck portion 64 when the closure member 80 is in the closed position shown in FIG. 4. The contact between flange 96 and inside neck portion 64 provides liquid-tight seal by which the contents of the container are prevented from flowing therethrough. The cup-shaped member 80 is placed in its open position by compressing bellows member 70, a shown in FIG. 5, forcing cup-shaped member 80 into the cavity of the container whereby the contents 66 are allowed to flow from the cavity through holes 86, 88, 90, 92, 94, and the other holes not shown into the outside environment. It should be noted that the holes 86 through 94 are elongated to provide a means by which a greater amount of liquid 66 is allowed to pass therethrough upon greater compression of bellows member 70. When cup-shaped member 80 is released and bellows member 70 is no longer compressed, the closure member 80 is automatically returned to its closed position by the natural resiliency of the bellows member 70 returning to its relaxed state.

Any of the embodiments shown herein may be fixed with respect to the container by integrally forming the lower conical surface of the bellows member with the port element. An alternative means by which any of the embodiments herein may be fixed with respect to the container is shown in FIG. 6. FIG. 6 shows an embodiment which is operatively identical to the embodiment of FIGS. 2 and 3, with the exception that the upper portion 20 of the container is not integrally formed with the neck portion 22. Instead, neck portion 22 is integrally formed with collar portion 100, and upper portion 20 is integrally formed with hollow extension 102. The inside surface of collar 100 and the outside surface of extension 102 are adapted to threadingly mate with one another.

A fourth preferred embodiment is shown in FIG. 7. This embodiment is designed to allow for the use of this system with contents composed generally of solid particulate matter. It should be noted that the previous embodiments present no problem for the flow of liquids through outlet holes which are on the side walls of the cup-shaped member. However, the movement solid granular particles through such outlet holes would require the particles to move at right angles on their path out of the container through the outlet holes. Liquid flows easily in such a manner, but solid particles do not.

Container 106 is shown to contain particles 108 in its cavity. Bellows member 110 is comprised of upper conical surface 112 and opposed conical surface 114. Lower conical surface 114 is integrally formed at the top of container 106. Closure member 115 is fixed with respect to the upper conical surface 112, as in previous embodiments.

Outlet means are provided in circumferential spaced-apart alignment on the upper conical-surface 112. Outlet means include a plurality of outlet holes, of which holes 116, 118, 120, and 122 are shown. These holes 116, 118, 120, and 122 provide the outlet means through which the granular contents 108 are allowed to flow through on a straight path out of the cavity of container 106.

Handle 124 is provided to allow a user of the system to move closure member 115 between the open position shown in solid lines in FIG. 7 and the closed position shown in dotted lines. Circumferential flange 126 provides the means, as in the first embodiment, to temporarily lock the closure member 115 in the closed position plugging the port element or neck portion 128 from receiving the flow of contents 108 therethrough.

A fifth embodiment is shown in FIGS. 8 through 11. This embodiment includes a closure member 144 to be moved from an initial closed position shown in FIG. 9 to an open position shown in FIG. 10. This embodiment does not provide a means for closure member 144 to be returned to its closed position once it is placed in its open position. This embodiment is best used with contents which are to be used within a short period of time after initial exposure to the outside environment. Container 156 is designed to be used with contents such as automotive liquids whereby the top portion 158 of container 156 is long and thin, adapted to be easily positioned in a small area over the inlet to a radiator, oil reservoir, gas tank, or the like. Bellows member 130 is comprised of upper conical surface 132 and opposed conical surface 134. Lower conical surface 134 is integrally formed with the upper portion 158 of container 156 at neck area 140. Outlet means are provided in this embodiment by hollow extension 136 which is integrally formed with upper conical surface 132. The outer circumference of extension 136 is provided with threads 138 which are adapted to threadingly mate with a threaded cap, not shown.

Figure 9:
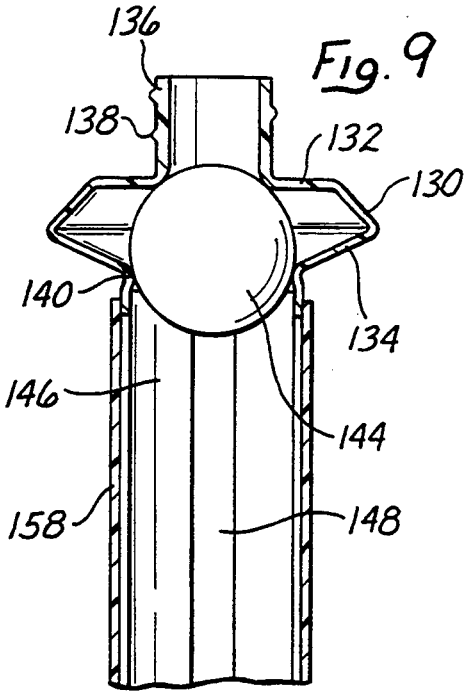
FIG. 9 is a cross-sectional view taken along line 9—9 of FIG. 8 illustrating the closure device in its initial closed position.
Figure 11:
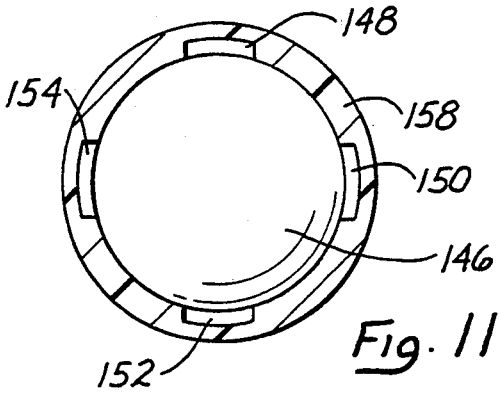
FIG. 11 is a cross-sectional view of the embodiment shown in FIG. 10 taken along line 11—11.

Closure member is a spherical element 144 which seats against the inside of neck portion 140 to provide a liquid-tight seal in the closed position shown in FIG. 9. Spherical element 144 is secured in this initial closed position by the upper conical surface 132 exerting sufficient pressure against spherical element 144.

Figure 10:
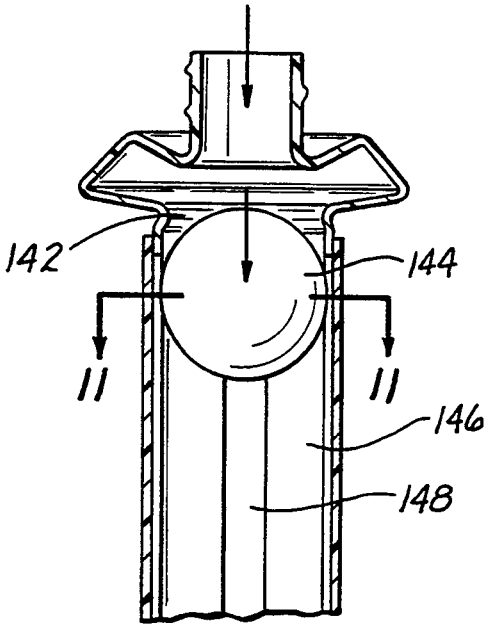
FIG. 10 is the same cross-sectional view of FIG. 9 illustrating the closure device in its open position.

This embodiment is placed in its open position, shown in FIG. 10, when additional pressure is exerted on spherical element 144 by compression of bellows 130.

The user of this system presses down on extension 136 to force upper conical surface 132 into spherical element 144. This downward pressure forces spherical element 144 to travel beyond port element 140 into the passageway 146 inside wall 158. When spherical element 144 is positioned within passage 146, spherical element 144 no longer provides a seal with neck portion 140. Longitudinal channels 148, 150, 152, and 154 within wall 158 provide a passageway for the liquid content of container 156 to travel past spherical element 144, through port element 140 and out of extension 136 into the outside environment. The spherical closure member 144 is now trapped within the hollow passage 146 by the inwardly projecting neck area 140. Once the closure member 144 is placed in the open position shown in FIG. 10, it cannot be returned to its closed position.

Figure 12:
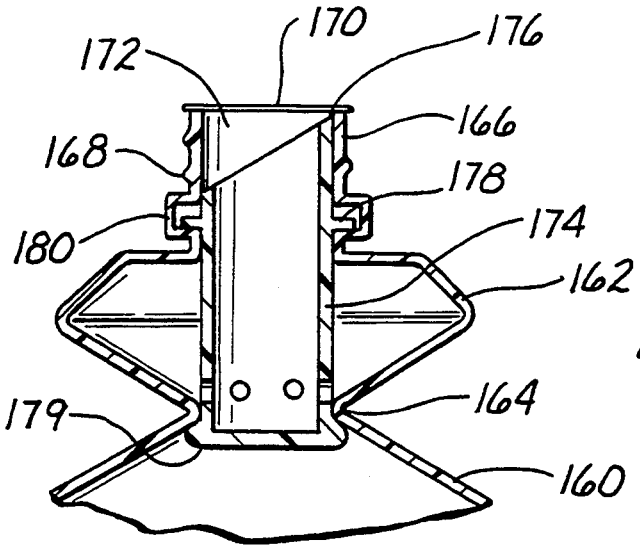
FIG. 12 is a cross-sectional view of yet another embodiment illustrating the system in an initial closed and sealed condition.
Figure 13:
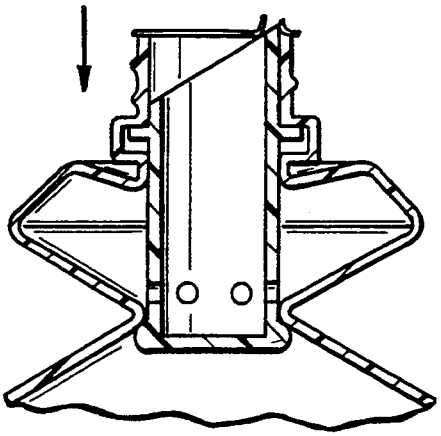
FIG. 13 is the same view of FIG. 12 illustrating the system in its closed, but unsealed, position.
Figure 14:
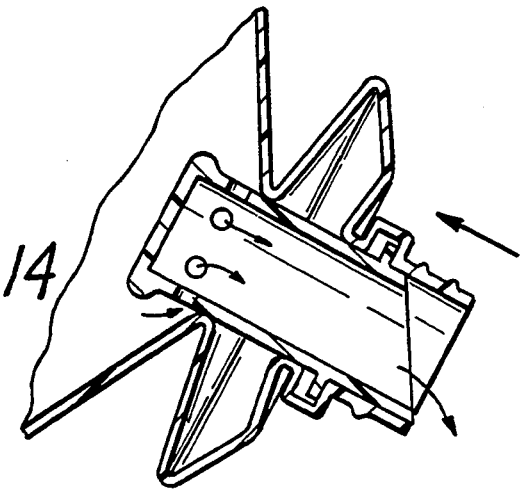
FIG. 14 is the same view of FIG. 12 illustrating the system in its unsealed and open position.

The final preferred embodiment is shown in FIGS. 12 through 14. Once again, this embodiment can be used in combination with previous embodiments and on one of any number of container designs. In this embodiment, bellows 162 is integrally formed with container 160 at neck area 164. Extension 166 is integrally formed with the upper conical surface of bellows 162. Threads 168 are provided on the outside surface of extension 166 for allowing a cap to be threaded thereon.

This embodiment provides a tamper-proof seal or foil element 170 to be adhered to the outlet 172 within extension 166. Foil 170 is used as a tamper-proof seal as is well known in the industry. Closure member 174 is provided with an inclined end 176 opposite circular base 179. This inclined end 176 serves as a puncturing edge to automatically puncture foil 170 upon initial opening of the closure member 174. Closure member 174 is provided with a second outwardly projecting radial flange 178 which moves within a circumferentially extending slot 180 on extension 166. Second flange 178 is allowed to travel a sufficient distance within slot 180 to allow the puncturing edge 176 to slice through foil 170 when bellows 162 is initially compressed as shown in FIG. 13.

When bellows member 162 is initially compressed a distance equal to the height of slot 180, the foil 170 is punctured by the inclined edge 176, but the closure member 179 remains in the closed positions shown in FIGS. 12 and 13. Additional compression of bellows member 162 is required to move closure member 178 into the open position shown in FIG. 14.

The invention is not limited to the embodiment described above, but all changes and modifications thereof, not constituting departures from the spirit and scope of the invention, are intended to be included.

What is claimed is:

1. A closure system for a container comprising:

a bellows member having a first end area integrally formed with the wall of said container and a second end area; the inside wall of said container at said first end area defining a throat element;

a closure member axially movable within said throat element; said closure member contacting said second end area; said closure member having a plug portion preventing the flow of fluid material through said throat element when said plug portion is in a closed portion within said throat element; said closure member further having outlet means for permitting the flow of fluid material between the inside of said container and the outside environment when said plug portion is not in said closed position;

said bellows member biased to support said closure member in said closed position when said bellows member is in its relaxed state;

said bellows member allowing said closure member to be moved out of said closed position.

2. The closure system of claim 1 wherein said closure member is fixed to the second end area of said bellows member.

3. The closure system of claim 2 wherein said bellows member includes a surface are adapted to contact the opening rim of a receptacle wherein movement of said container towards said receptacle with said surface area is in contact with said rim moves said closure member out of said closed position.

4. The closure system of claim 1 wherein said closure member is integrally formed with the second end area of said bellows member.

5. The closure system of claim 1 further comprising sealing means for sealing said outlet means whereby fluid communication between the inside of said container and the outside environment is prevented.

6. The closure system of claim 5 further comprising unsealing means for unsealing said outlet means.

7. The closure system of claim 5 wherein said closure member further includes an unsealing portion which is movable by said bellows member to unseal said outlet means.

8. The closure system of claim 7 wherein said bellows member comprises:

a first conical surface; and, a second conical surface integrally formed with and opposed to said first conical surface.

9. The closure system of claim 8 wherein the outside wall of one of said conical surfaces includes a surface area adapted to contact the opening rim of a receptacle whereby movement of said container towards said receptacle when said surface area is in contact with said rim moves said closure member out of said closed position.

10. The closure system of claim 1 wherein said fluid material is a liquid.

11. The closure system of claim 1 wherein said fluid material is a plurality of small particles.

12. The closure system of claim 1 wherein the inside wall of said container at said throat element defines a circle having a diameter; said diameter being fixed whereby movement of said bellows member does not alter the size of said diameter.

13. The closure system of claim 1 wherein the walls of said bellows member are of constant thickness.

14. The closure system of claim 1 wherein a liquid tight seal is created between the plug portion and the throat element when said closure member is in said closed position.

* * * * *